United States Patent [19]

Kanazawa et al.

[11] 4,440,300

[45] Apr. 3, 1984

[54] MOLDING DEVICE FOR NESTED PIPES

[75] Inventors: Tatsuo Kanazawa, Kamagaya; Tsuneo Suyama, Narita, both of Japan

[73] Assignee: Kubota, Ltd., Osaka, Japan

[21] Appl. No.: 368,133

[22] Filed: Apr. 14, 1982

[30] Foreign Application Priority Data

Jul. 31, 1981 [JP] Japan ..... 56-121254

[51] Int. Cl.[3] ..... B65D 85/20; B65D 85/62; F16L 7/00

[52] U.S. Cl. ..... 206/446; 206/443; 206/514; 206/821

[58] Field of Search ..... 206/446, 443, 514, 821; 414/431, 910; 138/148; 220/323

[56] References Cited

U.S. PATENT DOCUMENTS

| | | | |
|---|---|---|---|
| 109,739 | 11/1870 | Huntly | 206/514 |
| 1,975,269 | 10/1934 | Gray | 138/148 |
| 2,052,223 | 8/1936 | Evans | 220/323 |
| 2,423,986 | 7/1947 | Lathrope | 206/446 |
| 2,447,206 | 8/1948 | Price | 206/446 |
| 2,875,918 | 3/1959 | Baumier | 220/323 |
| 4,250,928 | 2/1981 | Nishikawa | 206/821 X |
| 4,253,792 | 3/1981 | Nishikawa | 414/589 |
| 4,341,392 | 7/1982 | van Dorgerer | 138/148 |

FOREIGN PATENT DOCUMENTS

| | | | |
|---|---|---|---|
| 756155 | 8/1956 | United Kingdom | 220/323 |

*Primary Examiner*—William T. Dixson, Jr.
*Assistant Examiner*—Brenda J. Ehrhardt
*Attorney, Agent, or Firm*—Joseph W. Farley

[57] ABSTRACT

A device for holding pipes of different diameters in a nested state comprising a plurality of engaging members each having at an intermediate portion thereof an abutting portion adapted to contact the socket end of each diametrically small pipe for restraining the small pipe from moving axially thereof, each of the engaging members being provided at least at its one end with an engaging portion fittingly engageable in an annular groove formed in the inner periphery of the socket of the diametrically largest pipe; and one or more connecting means for removably connecting the engaging members together. The holding device comprises lightweight components, is simple in construction and can be attached to nested pipes easily for holding the pipes reliably at all times.

10 Claims, 8 Drawing Figures

II
II
1
1A
1B
1C
1D
2
3
4
5
6
7
8A
8B
9
9b
9'
9'b
10
12
13
14

MOLDING DEVICE FOR NESTED PIPES

The present invention relates to a device for holding nested pipes to one another each at its socket end.

When nested, pipes of different diameters can be transported with effective use of the loading space. This method of transport is also very advantageous because diametrically small pipes function to reinforce diametrically larger pipes against deformation.

When thus nested for transport, the pipes must of course be held to one another. A holding device is known which is used for this purpose and which is in the form of a frame having radially extending support bars. The holding frame is arranged at the socket ends of the nested pipes, and the pipes are held to the frame in engagement therewith. The device, however, involves the problem that the frame is large-sized and heavy and needs therefore to be made at a high material cost. Another device is known by which an outer pipe and an inner pipe fitted therein are held to each other by small members arranged circumferentially of the pipes, but this device requires an increased number of components and involves difficulty in reliably holding the pipes together when they differ greatly in diameter.

The object of the invention is to provide a device for holding nested pipes to one another easily and reliably at all times although the device comprises a small number of components which are lightweight.

To fulfill this object, the invention provides a device for holding pipes of different diameters in a nested state which comprises a plurality of engaging members and one or more connecting means for removably connecting the engaging members together. Each of the engaging members has at an intermediate portion thereof an abutting portion adapted to contact the socket end of each diametrically small pipe for restraining the small pipe from moving axially thereof and is provided at least at its one end with an engaging portion fittingly engageable in an annular groove formed in the inner periphery of the socket of the diametrically largest pipe.

The invention further provides a nested pipe assembly with use of the holding device of the above construction.

Various features and advantages of the invention will be readily understood from the following description of embodiments and modifications thereof given with reference to the accompanying drawings, in which.

Throughout the drawings, like parts are referred to by like reference numerals.

The embodiment shown in FIGS. 1 to 4 will be described first with reference to a case wherein four pipes 1 of different diameters are nested. (The pipes 1 decreasing in diameter will be referred to as a first pipe 1A, second pipe 1B, third pipe 1C and fourth pipe 1D in the order of the decreasing diameters.)

Figure 1:
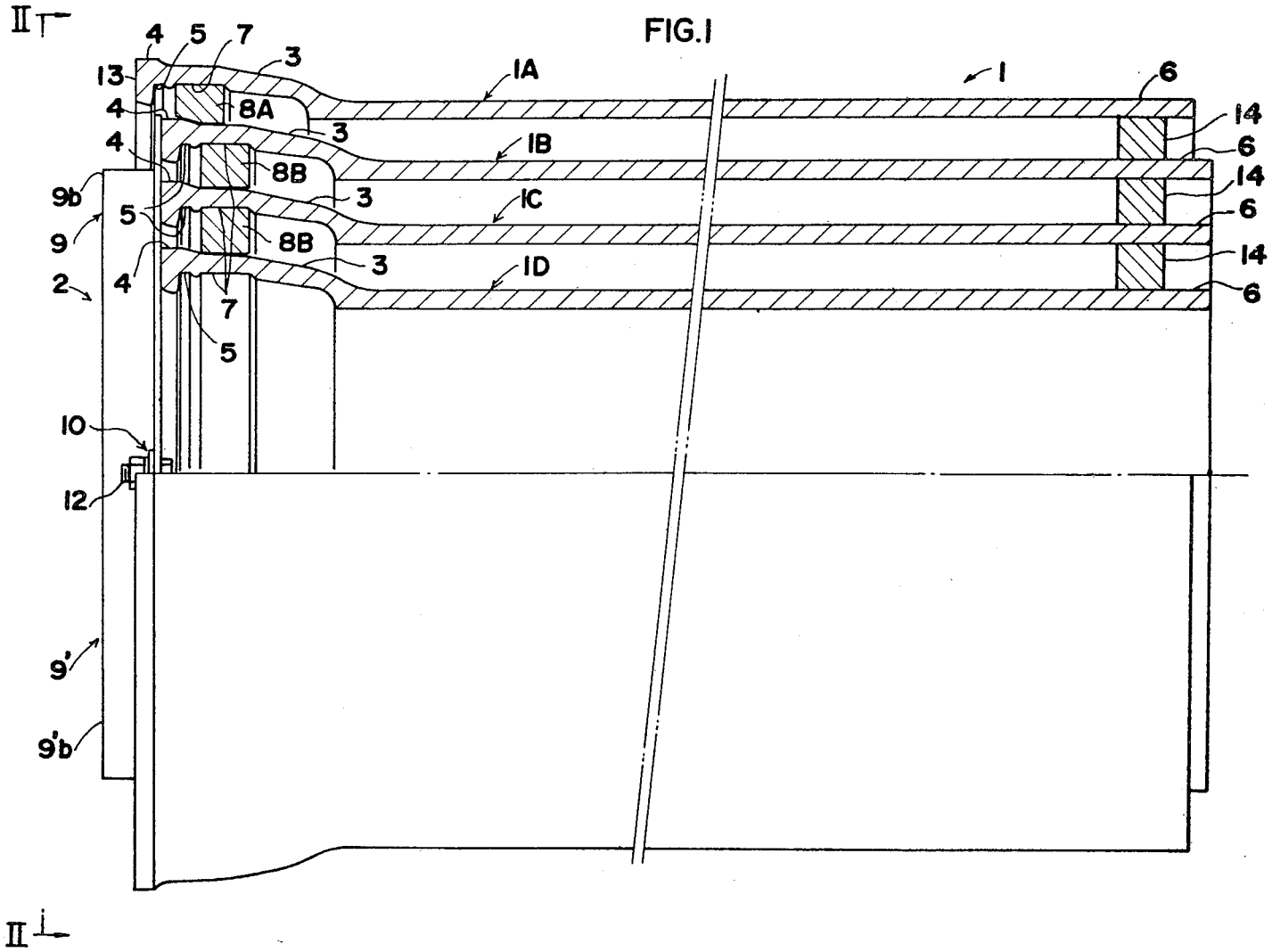
FIG. 1 is a side elevation partly in section and showing nested pipes which are held together by a holding device embodying the invention.
Figure 4:
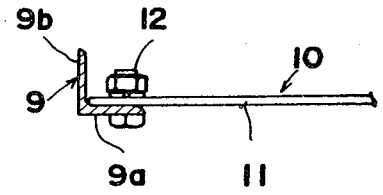
FIG. 4 is a view in section taken along the line IV—IV in FIG. 2.
Figure 2:
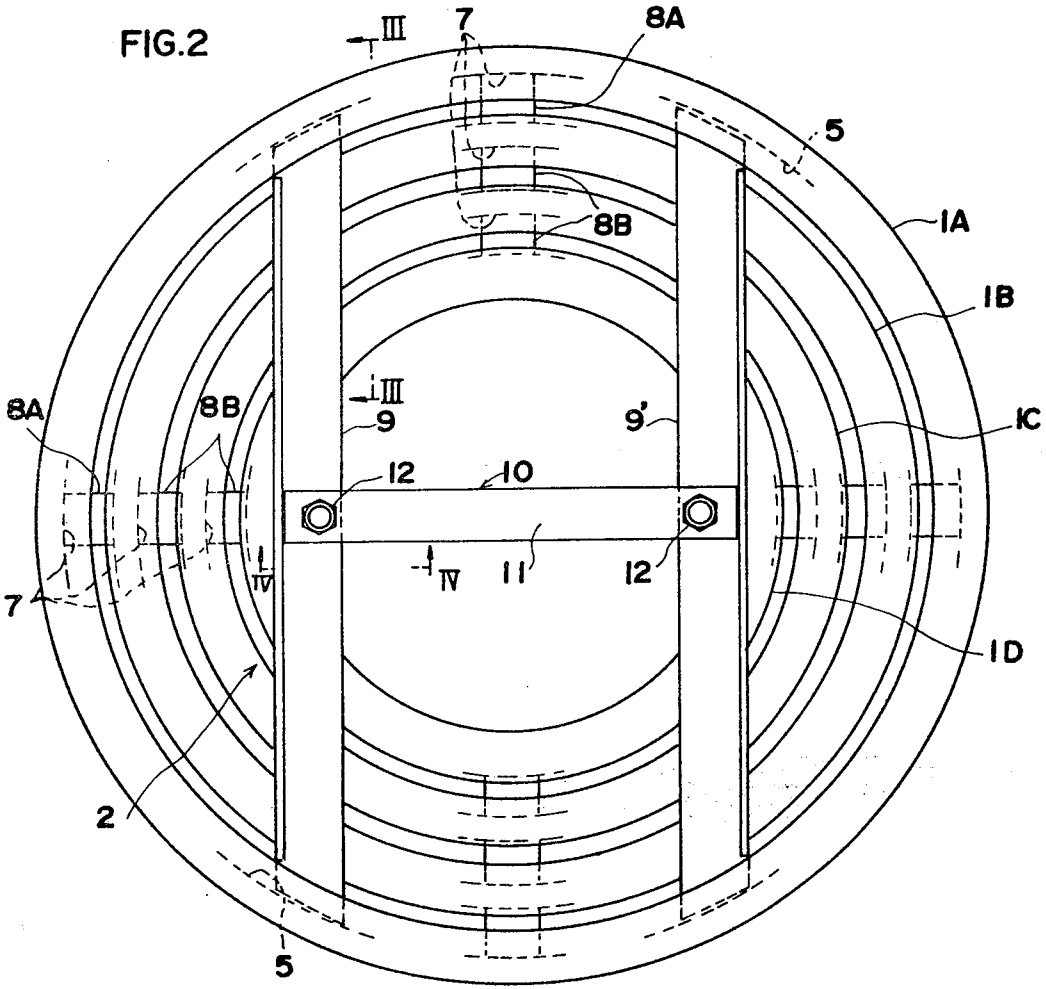
FIG. 2 is a front view showing the pipes as they are seen in the direction of the line II—II in FIG. 1.
Figure 3:
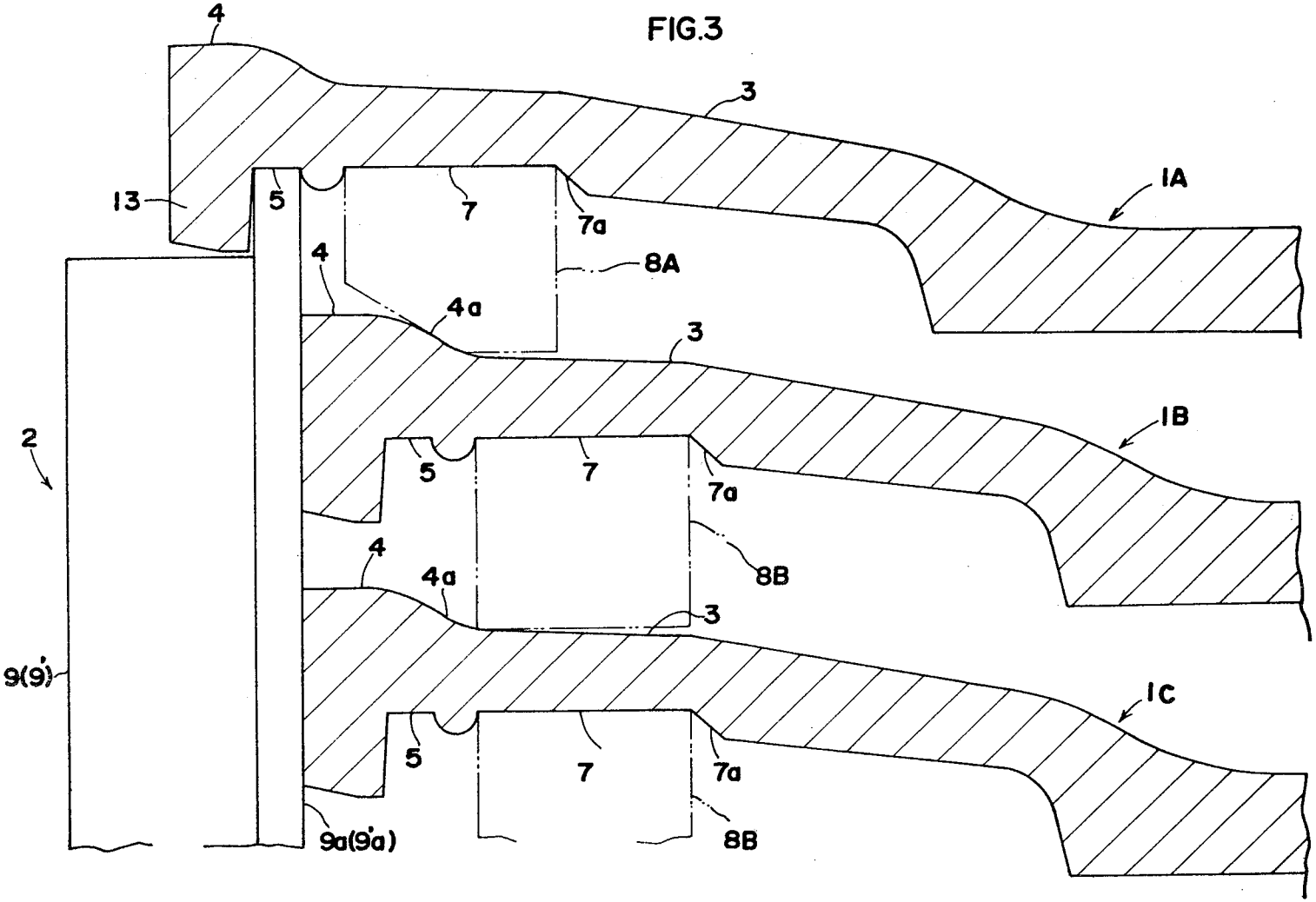
FIG. 3 is an enlarged view in section taken along the line III—III in FIG. 2.

The pipes 1 for which a holding device 2 of the invention is used have sockets 3 of the construction shown in FIG. 3. The end portion of each socket 3 has an annular projection 4 on its outer periphery and is formed in its inner periphery with an annular groove 5 and an annular recess 7 adjacent the groove 5 on one side thereof closer to a spigot 6. The body of the pipe 1 extends to provide the spigot 6 which is not of any special shape.

The nested pipes 1 are held spaced apart from one another radially thereof by socket spacers 8. Each of the spacers 8 comprises blocks; for example, of wood, resin or rubber. These blocks are provided between a diametrically large pipe, for example, the first pipe 1A and a diametrically smaller pipe, for example, the second pipe 1B and spaced apart circumferentially thereof, for example, at four locations. The blocks are in engagement with a slanting side face 7*a* defining the annular recess 7 of the pipe 1A at one side of the recess closer to the spigot 6 and with a slanting side face 4*a* forming one side, closer to the spigot 6, of the annular projection 4 of the pipe 1B. Accordingly the spacer 8A restrains the pipes 1A and 1B from moving relative to each other radially thereof and also restrains the small pipe 1B from moving into the large pipe 1A. Spacers 8B slightly different from the spacer 8A in shape are used for the second pipe 1B and the third pipe 1C, and for the third pipe 1C and the fourth pipe 1D because the first pipe 1A is displaced from the other pipes 1B, 1C and 1D when they are held together to insert the pair of engaging members to be described later into the annular groove 5 of the pipe 1A.

The holding device of this invention will be described in greater detail. The holding device 2 has the function of preventing the diametrically small pipes 1B, 1C, 1D from slipping outward from the diametrically large pipe 1A. The device 2 comprises a plurality of engaging members, for example a pair of engaging members 9, 9′ in the case of the present embodiment, for preventing the nested pipes 1 from moving relative to one another axially thereof, and connecting means 10 for connecting the engaging members 9, 9′ together as spaced apart from each other.

The pair of engaging members 9, 9′ comprise, for example, angle bars including abutting portions 9*a*, 9′*a* and reinforcing portions 9*b*, 9′*b*. The abutting portions 9*a*, 9′*a* are caused to bear against the end faces of the sockets 3 of the small pipes 1B, 1C, 1D, and the upper and lower ends of these members 9, 9′ are fittingly engaged in the annular groove 5 of the diametrically largest pipe 1A.

The connecting means 10 comprises a connecting rod 11 of suitable length and bolts and nuts 12 for fixing the opposite ends of the rod 11 to the midportions of the engaging members 9, 9′, whereby the engaging members 9, 9′ are firmly connected together as spaced apart by a suitable distance, with their opposite ends held engaged in the annular groove 5 of the largest pipe 1A.

The length of the pair of engaging members 9, 9′ is of course smaller than the inside diameter of a flange 13 at the socket end of the largest pipe 1A. The reinforcing portions 9*b*, 9′*b* are partly cut out so as not to interfere with the flange 13 when the members 9, 9′ are installed in place.

The holding device 2 is used in the following manner. The pipes 1 are nested with the spacers 8 temporarily held in the annular recesses 7, and spigot spacers 14 are inserted into the spigots 6 between the adjacent pipes. At this time, the pipes 1 are nested with the largest pipe 1A displaced from the other smaller pipes 1B, 1C, 1D by the widths of the annular groove 5 and the flange 13 of the pipe 1A. The pair of engaging members 9, 9′ are then inserted into the largest pipe 1A axially thereof in its center and thereafter moved diametrically outward into engagement with the annular grooved portion 5 of the pipe 1. Subsequently the connecting rod 11 is fixedly connected to the engaging members 9, 9′ by bolts and nuts 12, whereby the nested pipes 1 can be prevented from moving relative to one another radially and axially thereof.

Modifications of the present embodiment will now be described with reference to FIGS. 5 to 8.

Figure 5:
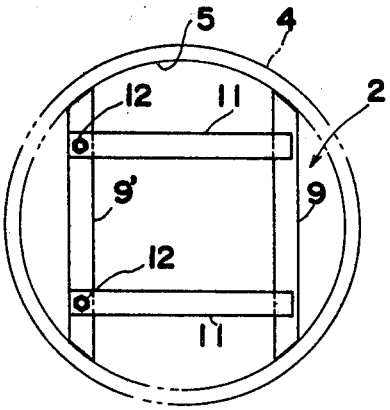
FIGS. 5 to 8 are front views showing modifications of the embodiment.

FIG. 5 shows a holding device 2 including two connecting rods 11 integrally joined each at its one end to an engaging member 9. The other ends of the connecting rods 11 are connected to another engaging member 9′ by bolts and nuts 12.

Figure 6:
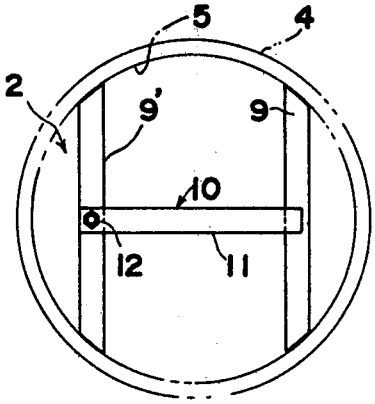

FIG. 6 shows a holding device 2 including a connecting rod 11 integrally joined at its one end to the midportion of an engaging member 9 and connected at the other end thereof to another engaging member 9′ by a bolt and a nut 12.

Figure 7:
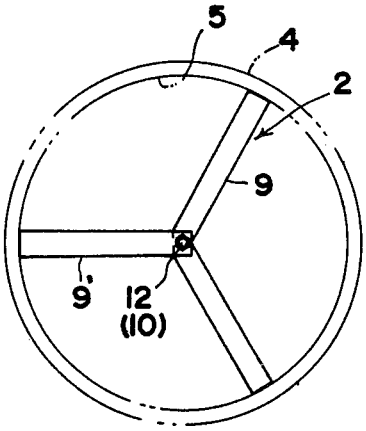

FIG. 7 shows a holding device 2 Y-shaped in its entirety and comprising a V-shaped engaging member 9 and another engaging member 9′ directly connected to the bent portion of the engaging member 9 by a bolt and a nut 12. In this case, the bolt and nut 12 serve as connecting means 10.

Figure 8:
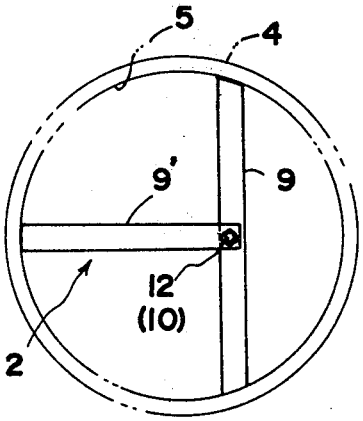

FIG. 8 shows a holding device 2 comprising two engaging members 9, 9′ connected to each other in a T-shaped arrangement by a bolt and a nut 12, which also serve as connecting means 10.

The engaging members shown in FIGS. 1 to 4 are angle bars but can be plates. Similarly the engaging members shown in FIGS. 5 to 8 can be plates, angle bars or the like.

Since none of the holding devices 2 described above inherently have the function of preventing the small pipes 1B, 1C, 1D from moving in the direction of insertion thereof into the largest pipe 1A and holding the pipes spaced apart radially thereof, the devices are used in combination with the socket spacers 8A; 8B at all times. However, if the engaging members are provided with engaging pawls fittingly engageable in the annular grooves 5 of the small pipes 1B, 1C, 1D, it is no longer necessary to use the socket spacers 8A, 8B. Further instead of rendering the opposite ends of the engaging members fittingly engageable directly into the annular groove 5 of the largest pipe 1A, these ends can be provided with engaging pawls which are fittingly engageable in the annular groove 5. In this case, all the nested pipes are held with their socket ends flush with one another.

Since it is impossible to install the socket spacer 8 in position after large and small pipes have been nested, it is necessary to hold the spacer in the annular recess 7 of the large pipe first so that the spacer will not interfere with the insertion of the small pipe into the large pipe. This requirement can be fulfilled by a spacer of the self-sustaining type which comprises an annular steel band and wood, resin, rubber or like blocks attached to the steel band and arranged at a suitable spacing circumferentially thereof. Self-sustaining spacers of various other constructions are useful although only one example thereof is herein mentioned.

On the other hand, the spigot spacer 14, which can be attached to two nested pipes, is usable irrespective of whether it is of the self-sustaning type or not.

What is claimed is:

1. A device for holding pipes of progressively decreasing diameters in a nested state, said device including a frame structure adapted to be assembled and disassembled and comprising at least two beam members, each beam member having ends spaced apart a distance less than the internal diameter of the socket end of the diametrically largest pipe and having an intermediate portion adapted to abuttingly contact the socket end face of each diametrically smaller pipe, one of said beam members being provided at both of its ends with engaging portions adapted to fit in an annular groove formed in the inner periphery of the socket of the diametrically largest pipe, at least one end of the other of said beam members being provided with an engaging portion adapted to fit in said annular groove of the diametrically largest pipe socket, and connecting means for detachably connecting said beam members together whereby said beam members and connecting means are adapted to be assembled to form said frame structure.

2. A holding device as defined in claim 1 wherein said frame structure comprises a pair of straight beam members each having the engaging portion at each end thereof.

3. A holding device as defined in claim 2 wherein the connecting means comprises a straight connecting rod, and a bolt and a nut for fixedly connecting each end of the rod to a corresponding beam member.

4. A holding device as defined in claim 2 wherein the connecting means comprises a connecting rod integrally joined at one of its ends to one of the beam members, and a bolt and a nut for fixedly connecting the other end of the rod to the other beam member.

5. A holding device as defined in claim 1 wherein said frame structure comprises a V-shaped first beam member having the engaging portion at each end thereof, a straight second beam member having a engaging portion at one of its ends, and a bolt and a nut serving as the connecting means for fixedly connecting the other end of the second beam member to the bent portion of the first beam member.

6. A holding device as defined in claim 1 wherein said frame structure comprises a first straight beam member having the engaging portion at each end thereof, a second straight beam member having the engaging portion at one of its ends, and a bolt and a nut serving as the connecting means for fixedly connecting the other end of the second beam member to the midportion of the first beam member.

7. A holding device as defined in claim 1 wherein one end or each end of each of the beam members is fittingly engageable directly in the annular groove of the socket of the largest pipe to serve as the engaging portion.

8. A holding device as defined in claim 1 wherein each of the beam members comprises an angle bar.

9. A holding device as defined in claim 1 wherein each of the beam members comprises a flat plate.

10. A nested pipe assembly comprising nested pipes of different diameters; spigot spacer means interposed between the spigots of each two adjacent pipes; socket spacer means interposed between the socket of each two adjacent pipes restraining the diametrically smaller one of the two pipes from moving axially thereof in the direction of insertion thereof into the other diametrically larger pipe; and a holding device attached to the socket ends of the nested pipes; the holding device including a frame structure adapted to be assembled and disassembled and comprising at least two beam members, each beam member having ends spaced apart a distance less than the internal diameter of the socket end of the diametrically largest pipe and having an intermediate portion abuttingly contacting the socket end face of each diametrically smaller pipe, one of said beam members being provided at both of its ends with engaging portions fitting into an annular groove formed in the inner periphery of the socket of the diametrically largest pipe, at least one end of the other of said beam members being provided with an engaging portion fitting into said annular groove of the diametrically largest pipe socket, and connecting means detachably connecting said beam members together whereby said beam members and connecting means are assembled to form said frame structure.

* * * * *

UNITED STATES PATENT AND TRADEMARK OFFICE

CERTIFICATE OF CORRECTION

PATENT NO. : 4,440,300

DATED : April 3, 1984

INVENTOR(S) : TATSUO KANAZAWA ET AL

It is certified that error appears in the above—identified patent and that said Letters Patent is hereby corrected as shown below:

In the title, "MOLDING" should read --HOLDING--,

Column 4, line 40, "a engaging" should read --the engaging--.

Signed and Sealed this

Fourth Day of September 1984

[SEAL]

*Attest:*

GERALD J. MOSSINGHOFF

*Attesting Officer*

*Commissioner of Patents and Trademarks*